US007463141B2

(12) United States Patent
Michel et al.

(10) Patent No.: US 7,463,141 B2
(45) Date of Patent: Dec. 9, 2008

(54) CASS (COMPUTER ALARM SECURITY SOFTWARE)

(75) Inventors: Guirand Michel, 19 GayLord St., Boston, MA (US) 02124; Joubert Michel, 19 GayLord St., Boston, MA (US) 02124

(73) Assignees: Guirand Michel, Boston, MA (US); Joubert Michel, Boston, MA (US)

( * ) Notice: Subject to any disclaimer, the term of this patent is extended or adjusted under 35 U.S.C. 154(b) by 488 days.

(21) Appl. No.: 11/098,790

(22) Filed: Jul. 18, 2005

(65) Prior Publication Data

US 2006/0092009 A1 May 4, 2006

Related U.S. Application Data

(60) Provisional application No. 60/564,122, filed on Apr. 22, 2004.

(51) Int. Cl.
*G08B 1/00* (2006.01)

(52) U.S. Cl. ..... 340/531; 340/506; 340/3.1; 379/37; 379/39; 379/51

(58) Field of Classification Search ..... 340/531, 340/506, 3.1; 379/37, 39, 51
See application file for complete search history.

(56) References Cited

U.S. PATENT DOCUMENTS 5,400,246 A * 3/1995 Wilson et al. ..... 700/17

* cited by examiner

*Primary Examiner*—Daryl C Pope

(57) ABSTRACT

The software configurations of a personal computer allow it to provide portable home security to poor American families and small business owners. When a security breach is detected, a wave file out of the computer speakers serves as a detection alarm to the intruder, while another wave file serves as a notification to the homeowner. The personal computer program would automatically loop through different telephone numbers, as preset. The homeowner has the responsibilities to stop, reset or dispatch the appropriate authorities base on the nature of the notification.

1 Claim, 4 Drawing Sheets

CASS (COMPUTER ALARM SECURITY SOFTWARE)

CROSS-REFERENCE TO RELATED APPLICATIONS

This application claims the benefit of provisional patent application Ser. No. 60/564,122, entitled "Computer Alarm Security System" Filed on Apr. 22, 2004 by the present inventors.

FEDERALLY SPONSORED RESEARCH

Not applicable

PROGRAM LISTING

The listing of the Computer Alarm Security System (CASS) is provided on the CDs. Please, be informed that the disk labeled "Copy2" is a duplicate of the disk labeled "Copy1". Each disk contains a copy of the file "CASSLISTING" Both disks are formatted as ASCII.

Two CDs containing the fully developed Computer Alarm Security System (CASS) program interface were sent on Mar. 17, 2005 for reference purposes only. They are also duplicated of each other and should be labeled "Copy1" for one disk, and "Copy2" for the other. Because the disks are duplicated of each other, the order of labeling does not matter. Please make use of the included labels.

BACKGROUND OF INVENTION

1. Field of Invention

This invention relates to computer automated home base security systems.

2. Prior Art

Many security companies require that you buy the basic security system package first. Something that ranges approximately from 450 dollars up to 30000 dollars, or so, it all depends on what you want to secure, and the size of the area that will be covered.

Soon after you owned the security package, the security company starts charging you a monthly payment for monitoring. As soon as you stop paying the monthly payment, you no longer have security. You end up with multiple boxes, holes, many sensors, dedicated video cameras and wires that run all over your house walls that do nothing. You lost all deposits, fees and initial basic package investment. Such unfair system frustrates many American families, particularly the poor middle class families and small business owners.

Security companies make use of a variety of security equipment, such as dedicated video cameras, motion detectors, vibration sensors, pressure sensors, heat sensors, warning sirens equipment, dedicated Network Interface Devices (NID) and telecommunication network equipment. Too many dedicated electronic hardware render the security system expensive and completely non-portable. If the subscriber needs to move to another house, he/she has to pay for new installation fees.

According to the National Burglar & Fire Alarm Association (NBFAA), each year there are more than 2 million burglaries in the U.S. Not taking precautions against crimes and burglaries can have painful consequences, not only on American families, but also our children, as well as, the future of the American society. The American government cannot protect every American citizen against crimes and burglaries. As a result poor American families who do not own a security system are left alone in the battle against crimes.

Many middle classes and poor American families are well aware of the risks that involve living without the minimum home security system possible. However, they cannot afford the cost of home security system on the market today. The minimum-security coverage on the market today requires many payments in advance, such as packages and installation fees, as well as a monthly payment of approximately 75 dollars and up. Poor and middle classes American families accept to run the risk of living many painful moments of crimes against their love ones, only because they cannot afford today's high cost of home security.

Security equipment such as motion detectors, heat sensors and the like are not perfect. Base on the nature of those electronic sensors, they sometimes false triggering. When a motion sensor false triggering, the end result is a false alarm notification signal. Security companies do not know how to eliminate false alarms in their security systems; therefore, when a security breach occurs, they rely on their customers for information on the nature of the alarm.

Security companies unfairly charge their customers extra security fees due to false alarms. Very often the customer has nothing to do with that. The position of a motion sensor, as well as, temperature variations could cause security equipment to false triggering. There are a number of variables that could cause a sensor to false triggering. Most often such parameters are not related to the customer at all. Charging the customer a high fee for false notifications is obviously unfair.

Security companies developed a verification protocol, consisting of calling the subscriber's home telephone number to ask questions about the notification signal. They are hopping to find someone to give them a clue on the nature of the security breach. They often provide the customer a security password that they ask for. If the provided password were correct, they would cancel the dispatch of security personnel. On the other hand if the code provided were not correct, they would dispatch the appropriate security personnel. Desperate with the problem of false alarms, security companies keep in their database, names and telephone numbers of friends and neighbors of their subscribers.

BACKGROUND OF INVENTION—OBJECTS AND ADVANTAGES

The average American who is willing to protect his/her family, is paying too much for basic home security. Package costs, as well as, the monthly payment for monitoring are not affordable. The invention of Computer Alarm Security System (CASS) tackles the problem of insecurity in America and may have found a solution to the problem of home base insecurity in America.

Because the problem is due to high costs of security, the primary vision is to create an affordable security system for small businesses and poor American families. This predicament was approached at many different angles.

Brief

My brother and I (the present inventors) spent everything we own into researching how to implement an inexpensive security system. Despite all, nothing has been found. Fortunately our vision is too strong to allow us to quit. My brother and I (the present inventors) have decided to transform the personal computer into an effective home security apparatus. The idea is anyone who already owns a computer can afford home security. After many years of researches the dream comes true. My brother and I (the present inventors) have developed the Computer Alarm Security System (CASS). CASS can be the most affordable home security system today.

Visions

My brother and I (the present inventors) dream to see every computer in the U. S comes preloaded with the CASS software and build-in motion detector direct from the manufacturer. So, computer owners will only have to own a computer to be in possession of an operable home security system that they can use at not extra cost. What a revolution that would be, in the area of personal and home security. Because the Computer Alarm Security System (CASS) is completely portable, travelers can carry their laptop computers as a monitoring security apparatus anywhere.

Advantages

The innovation of the present invention is to use the customer's own personal computer as the center of the security system. This realization transfers control from the security company to the consumer. The owner of the Computer Alarm Security System (CASS) becomes the owner of his/her own security company; therefore all unfair fees are eliminated. The evolution of the Computer Alarm Security System (CASS) will force the majority of security companies to treat their customers fairly.

Using the personal computer as the center of the security system, Computer Alarm Security System (CASS) eliminates unnecessary and expensive hardware equipment. The personal computer comes with all that is needed to provide security; therefore, if the customer already has a computer, he/she can install the software and the necessary sensors to create his/her own basic security system.

There are a number of hardware security devices on the market that have little similarities with the Computer Alarm Security System. Unfortunately those devices are security boxes; therefore, the customer has to buy the sensors and the box. They are very static in their functionalities, and they are not software upgradeable.

Because the Computer Alarm Security System (CASS) uses a personal computer as the center of security, its functionalities are obviously unlimited. The Computer Alarm Security System (CASS) could be upgrade with new functionalities in a flash. Armed with Internet technology, the customer can download new functionalities from the vendor's web site.

Further objects and advantages will become apparent from a consideration of the detailed description and drawings.

SUMMARY OF THE INVENTION

In accordance with the present invention, the customer's own personal computer is transformed into an effective security system. Therefore, the invention makes it possible for any individual who already owns an operable personal computer to be in possession of a completely portable and software upgradeable security system. The only requirement involves is to have the Computer Alarm Security System Software legally installed.

DRAWINGS—FIGURES

The drawings represent four different aspects of the Computer Alarm (CASS) Security system.

Figure 4:
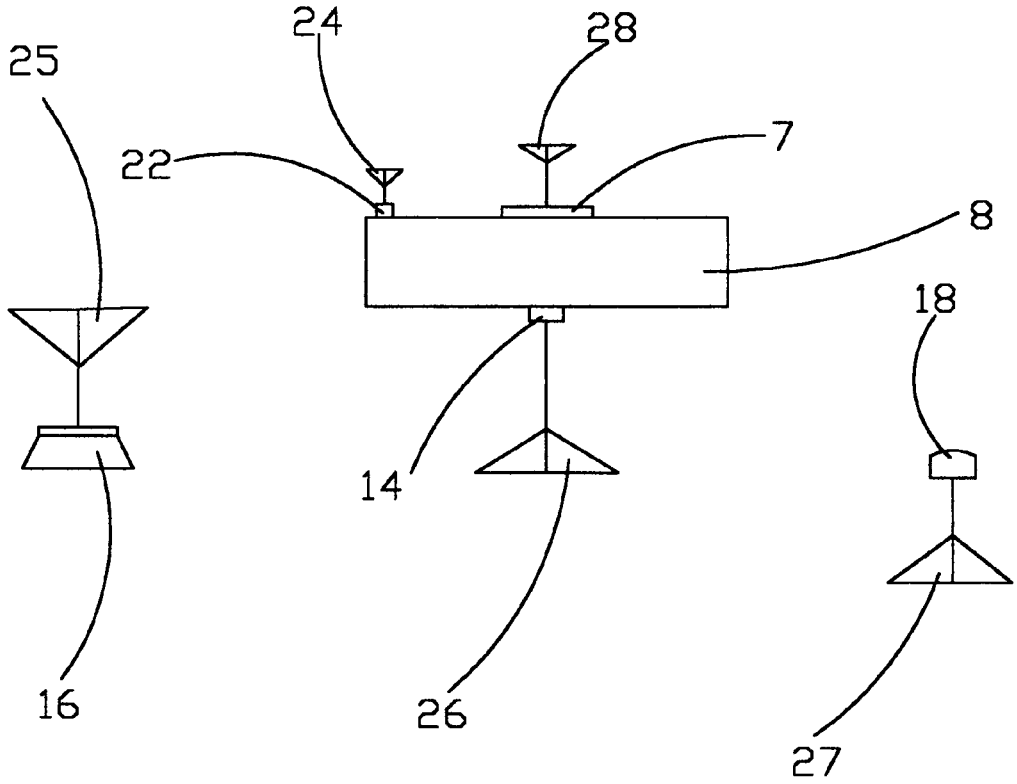

FIG. 4 represents a fully wireless aspect of the Computer Alarm Security System (CASS), where a wireless speaker system 16, 25, a wireless sensor system 18, 27 and a wireless modem 7, 28 is used as well. This aspect of the invention is a fully wireless system; therefore, the personal computer 8 is free to move around. Such embodiment could be used in very specific mobile security applications, in which very quick responses are critical.

DRAWINGS—REFERENCE NUMERALS

| | |
|---|---|
| 2--→ | inside house wall |
| 4--→ | phone jack |
| 6--→ | modem line |
| 7--→ | modem in/output jack |
| 8--→ | personal computer |
| 10-→ | wire |
| 12-→ | break-line |
| 14-→ | port (serial/PP/USB) |
| 16-→ | right speaker |
| 17-→ | left speaker |
| 18-→ | sensor (motion/heat/door trap/camera, etc . . .) |
| 20-→ | special cable system (SCS) |
| 22-→ | sound card output jack |
| 24-→ | speaker transmitting antenna |
| 25-→ | speaker receiving antenna |
| 26-→ | sensor receiving antenna |
| 27--→ | sensor transmitting antenna |
| 28--→ | modem transceiving antenna |

DETAILED DESCRIPTION OF THE INVENTION

Figure 1:
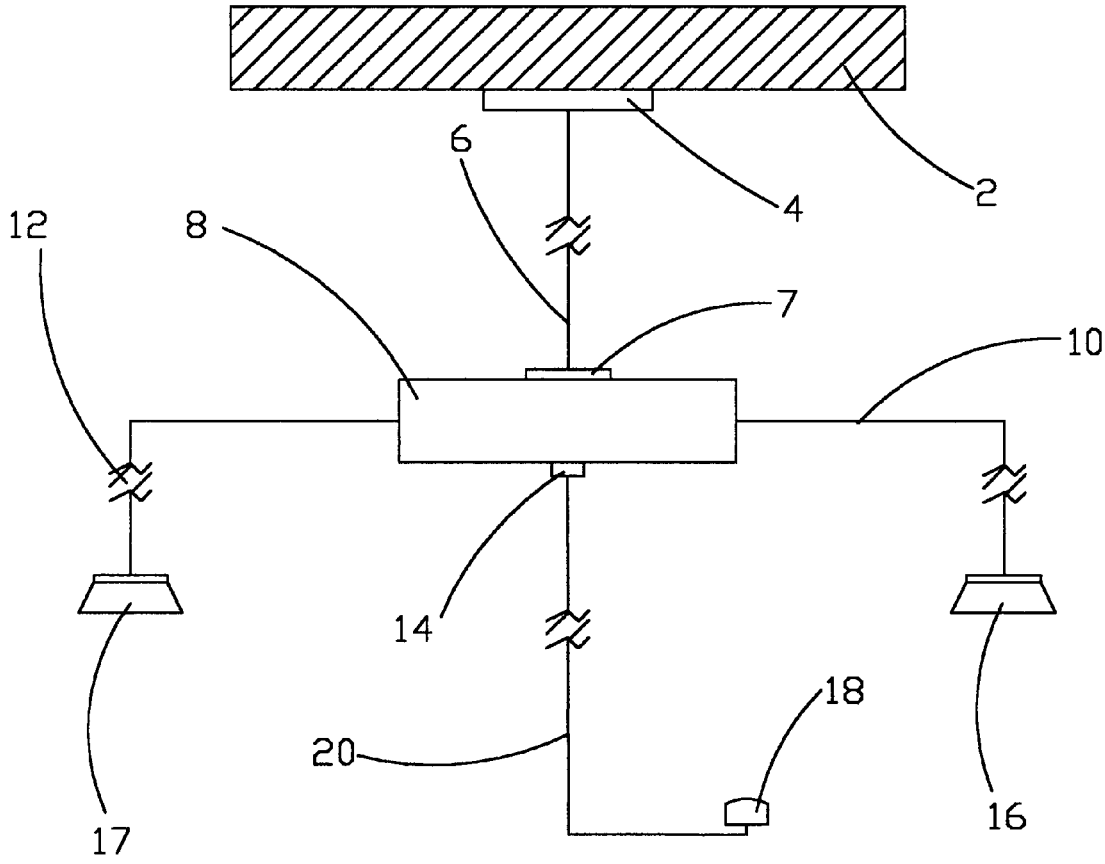
FIG. 1 is a fully wired Computer Alarm Security System (CASS), where every optional component is linked to the personal computer by a wire 10. The lengths of the wires are not specified; therefore, break-lines 12 are placed along the wires.

FIG. 1 Represents an Example Embodiment of the Fully Wired Computer Alarm Security System (CASS)

Soon after the software configurations of the Computer Alarm Security System (CASS), security is built around the customer's personal computer 8, using the least security equipment (sensor 18). The sensor 18 is connected to the serial port 14 connector of the personal computer 8 via a cable 20. The cable 20 is designed to transmit RS232 protocol from the sensor 18 to the personal computer 8. The customer must at least have one sensor connected to the serial port 14.

When a security breach is detected, communication between the sensor 18 and the personal computer 8 is established. A telephone call is placed within the modem output jack 7, through the modem line 6, through the phone jack 4. The telephone call is directed to one of the telephone numbers that the customer set during the configurations of the Computer Alarm Security System (CASS) Software. It is very significant to know that the telephone numbers are not hard-coded into the Computer Alarm Security System (CASS) software. The customer can choose any telephone number right out of the top of his/her head. In this embodiment we are assuming that the customer set his/her telephone number as the number to be called.

After the telephone call is placed on the modem line 6, an alarmed sound is sent to both, the right speaker 16 and the left speaker 17 of the personal computer 8. The sound file creates the alarmed sound effects indicating to the intruder that he/she has been detected, and he/she has to leave the premises immediately.

While the alarmed sound is playing, the customer's telephone would ring. If the customer's personal computer 8 were equipped with voice modem, as he/she answers, a voice sound would indicate the nature of the call. However, if the customer's personal computer 8 is only equipped with data fax modem, a DTMF warning sound would indicate the nature of the call.

The Computer Alarm Security System (CASS) software is implemented to call one of the configured telephone numbers as many times as the customer desires until an of-hook signal is detected. If the customer does not pick up the phone the Computer Alarm Security System (CASS) software would redirect the call.

After listening to the message, the customer has the option to stop the preset number of calls prematurely by entering a security code from his/her telephone keypad. Again the security code is not hard-code within the Computer Alarm Security System (CASS) software, the security code could be any desired combination of digits started from 0 to 9. The security code can be used to reset the Computer Alarm Security System (CASS).

Figure 2:
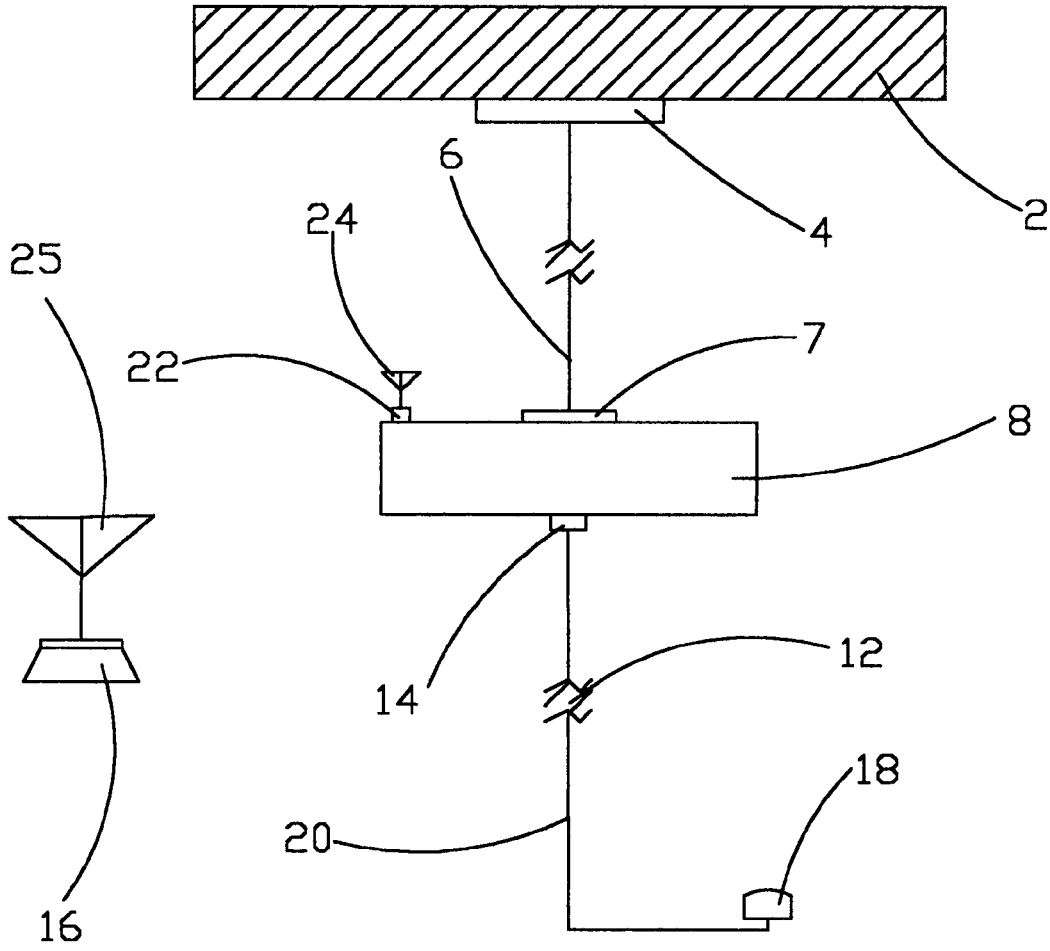
FIG. 2 represents another aspect of the Computer Alarm Security System (CASS), where an optional wireless speaker system 16, 25 is used.

FIG. 2 is Another Embodiment of the Computer Alarm Security System (CASS).

The representation in FIG. 2 shows the use of a wireless speaker system 16, 25. Everything in the Computer Alarm Security System (CASS) works the same as FIG. 1. The only advantage of the wireless speaker system is that it frees the speaker 16 from the personal computer 8. This advantage permits the customer to be able to hind the speaker system 16, 25 from the intruder. The alarmed sound file is transmitted from the transmitting antenna 24 to the receiving antenna 25 to the speaker 16.

Figure 3:
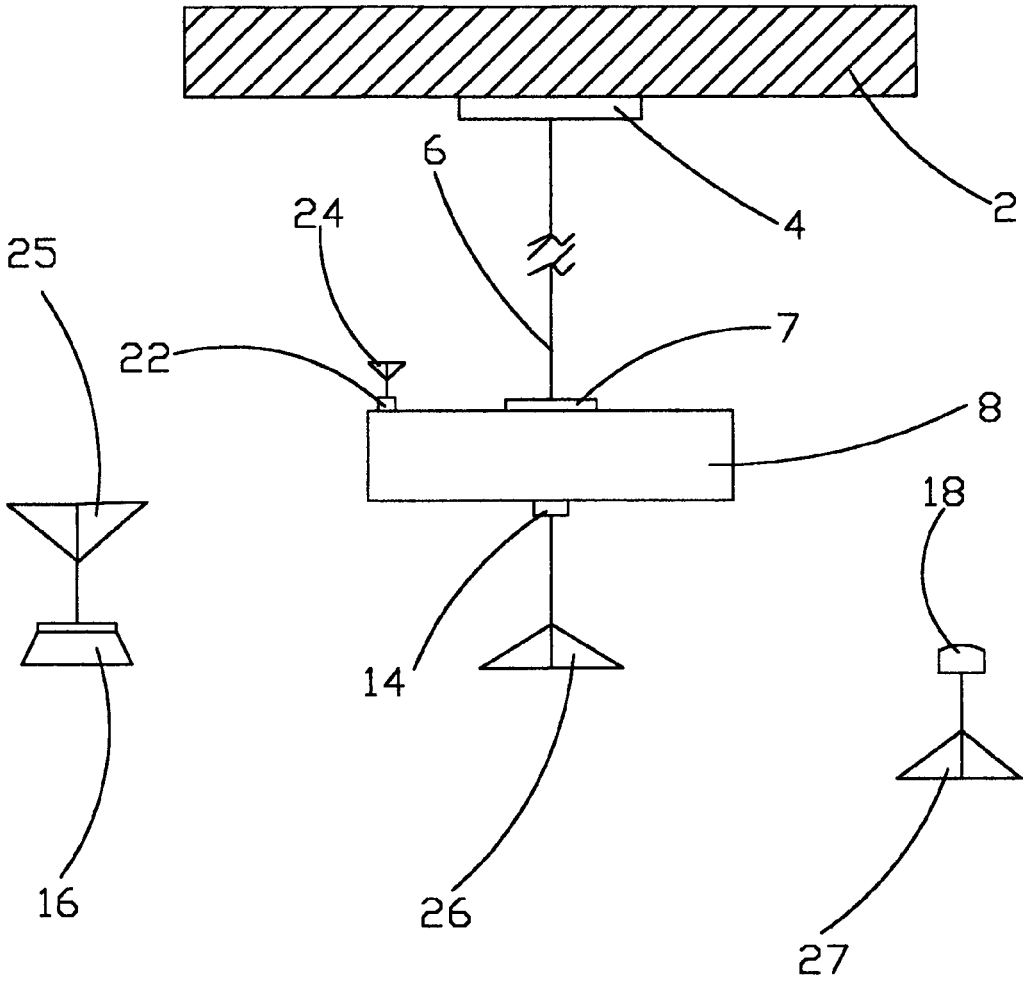
FIG. 3 represents an aspect of the Computer Alarm Security System (CASS), where not only an optional wireless speaker 16, 25 is used, but also a wireless sensor system 18, 27 is used.

FIG. 3 Shows Another Aspect of the Computer Alarm Security System (CASS).

Looking at FIG. 3, both the sensor 18 and the speaker 16 are wireless. This semi-wireless configuration of the Computer Alarm Security System (CASS) offers remarkable flexibilities, where the personal computer 8 could be remotely operated. At the moment of a security breach, the RS232 protocol between the sensor 18 and the personal computer 8 is transmitted via radio frequency, from the sensor's transmitting antenna 27 to the sensor's receiving antenna 26. The alarmed sound file is transmitted from the transmitting antenna 24 to the receiving antenna 25 to the speaker 16.

FIG. 4 Shows Another Embodiment of the Computer Alarm Security System (CASS).

Refer to Jan. 1, 1997 FIG. 3, not only both the sensor 18 and the speaker 16 are wireless, the modem is also wireless. This fully wireless configuration operates the same as FIG. 3; however, it offers the remarkable flexibilities. This configuration frees the personal computer 8 completely from all wire connections, and offers the remarkable flexibility of a mobile home security system.

We claim:

1. A method of using a consumer personal computer having a memory and a speaker to create a home based security system for a premises, the steps of said method consisting of:

detecting a security breach by an intruder;

sending a telephone call including security breach notifications to a consumer;

sending voice sound notifications to the consumer;

informing the intruder of the security breach;

recognizing an authorized security code;

wherein said step of sending the security breach notifications to the consumer includes:

transferring streaming wave files of DTMF tones from the memory to a telephone line and telephone of the consumer wherein, when the consumer does not answer the telephone after a preset number of rings, at least one of:

(a) redirecting the telephone call; and (b) continuing the call for another preset number of rings, is performed; and when the personal computer detects the security breach, an alarmed wave file from the memory is played out of the speaker indicating detection to the intruder, and as well, instructions to leave the premises immediately; and wherein said step of sending voice sound notifications includes use of Telephony Application Programming Interfaces to streamline sound files from the memory of the personal computer to the telephone line; and wherein said step of transferring DTMF tones includes using Telephony Application Programming Interfaces; and wherein said step of recognizing an authorized security code includes having the consumer to enter a security code to a telephone keypad, to either reset the system or to acknowledge the notification; and wherein said step of informing the intruder of detection includes using an MCI ActiveX control to play the alarmed wave file through the speaker of the personal computer.

* * * * *